US009228778B2

(12) United States Patent
Rampp

(10) Patent No.: US 9,228,778 B2
(45) Date of Patent: Jan. 5, 2016

(54) DEVICE FOR THE LOW-TEMPERATURE SEPARATION OF AIR

(75) Inventor: Augustin Rampp, Iffeldorf (DE)

(73) Assignee: LINDE AKTIENGESELLSCHAFT, Munchem (DE)

( * ) Notice: Subject to any disclaimer, the term of this patent is extended or adjusted under 35 U.S.C. 154(b) by 504 days.

(21) Appl. No.: 13/427,946

(22) Filed: Mar. 23, 2012

(65) Prior Publication Data

US 2012/0240621 A1 Sep. 27, 2012

(30) Foreign Application Priority Data

Mar. 25, 2011 (DE) ..... 10 2011 015 233

(51) Int. Cl.
*F25J 3/04* (2006.01)
*F25J 5/00* (2006.01)

(52) U.S. Cl.
CPC ..... *F25J 3/04466* (2013.01); *F25J 3/0489* (2013.01); *F25J 3/04218* (2013.01); *F25J 3/04872* (2013.01); *F25J 2200/04* (2013.01); *F28F 2265/26* (2013.01)

(58) Field of Classification Search
CPC ..... F25J 3/0423; F25J 3/0446; F25J 3/04466; F25J 3/04787; F25J 3/04872; F25J 3/04878; F25J 3/0489; F25J 3/04945; F25J 2290/34; F25J 2290/40; F25J 2290/42; F25J 3/04218; F25J 3/04187; F25J 2200/01; F25J 1/0262; F25J 1/0264; F25J 5/002002; F25J 2290/32; F28F 2265/26; F28F 9/0236
USPC ..... 62/640, 643; 165/81–83
See application file for complete search history.

(56) References Cited

U.S. PATENT DOCUMENTS 4,022,030 A 5/1977 Brugerolle
5,065,815 A * 11/1991 David et al. ..... 165/67
(Continued)

FOREIGN PATENT DOCUMENTS

DE 2 204 376 A1 8/1972
DE 198 03 437 A1 3/1999
(Continued)

OTHER PUBLICATIONS

European Search Report for EP 12 00 1385 dated Jun. 25, 2012.
(Continued)

*Primary Examiner* — Frantz Jules
*Assistant Examiner* — Keith Raymond
(74) *Attorney, Agent, or Firm* — Millen, White, Zelano, Branigan, P.C.

(57) ABSTRACT

The invention relates to an apparatus for the low-temperature separation of air and comprises a main heat exchanger (6) having at least two heat-exchanger blocks, a distillation column system for nitrogen-oxygen separation (5) having at least one high-pressure column, a subcooling-counterflow heat exchanger (2), means for introducing feed air via the main heat exchanger (6) into the high-pressure column, means for introducing a liquid stream from the distillation column system into the subcooling-counterflow heat exchanger (2), and means for introducing a gas stream (16) from the distillation column system into the subcooling-counterflow heat exchanger (2). The main heat exchanger (6) and the subcooling-counterflow heat exchanger (2) are arranged in a first cold box (12), and the subcooling-counterflow heat exchanger (2) is suspended from the main heat exchanger (6).

15 Claims, 1 Drawing Sheet

(56) References Cited

U.S. PATENT DOCUMENTS

| | | | | |
|---|---|---|---|---|
| 5,454,227 | A * | 10/1995 | Straub et al. | 62/646 |
| 5,461,871 | A * | 10/1995 | Bracque et al. | 62/643 |
| 5,490,391 | A | 2/1996 | Hogg et al. | |
| 5,617,742 | A * | 4/1997 | Toppel | 62/643 |
| 6,038,885 | A * | 3/2000 | Corduan et al. | 62/653 |
| 6,089,313 | A * | 7/2000 | Levy et al. | 165/140 |
| 6,134,915 | A * | 10/2000 | Denzau et al. | 62/643 |
| 6,148,637 | A * | 11/2000 | Guillard et al. | 62/643 |
| 6,378,331 | B1 * | 4/2002 | Vancauwenberghe et al. | 62/643 |
| 6,662,595 | B2 | 12/2003 | Corduan et al. | |
| 6,776,004 | B2 | 8/2004 | Rottmann et al. | |
| 7,325,594 | B2 * | 2/2008 | Wilhelm et al. | 165/135 |
| 7,621,152 | B2 * | 11/2009 | Howard | 62/620 |
| 2001/0052244 | A1 | 12/2001 | Rottmann et al. | |
| 2002/0124988 | A1 | 9/2002 | Takizawa et al. | |
| 2003/0051504 | A1 | 3/2003 | Corduan et al. | |
| 2004/0007016 | A1 | 1/2004 | Rottmann et al. | |
| 2007/0199344 | A1 | 8/2007 | Howard | |
| 2008/0307828 | A1 | 12/2008 | Prosser et al. | |
| 2009/0211295 | A1 | 8/2009 | Cavagne et al. | |

FOREIGN PATENT DOCUMENTS

| | | | |
|---|---|---|---|
| DE | 199 51 521 | A1 | 5/2001 |
| DE | 102 17 093 | A1 | 1/2003 |
| DE | 102 09 421 | A1 | 4/2003 |
| EP | 1 139 046 | A1 | 10/2001 |
| EP | 1 239 254 | | 9/2002 |
| EP | 1 284 404 | A1 | 2/2003 |
| EP | 1 376 037 | A1 | 1/2004 |
| EP | 1 387 136 | A1 | 2/2004 |
| EP | 1 666 824 | A1 | 6/2006 |
| WO | WO-2011 116981 | | 9/2011 |

OTHER PUBLICATIONS

Linde AG, "Device for the cryogenic separation of air," Espacenet, Publication Date: Sep. 29, 2011; English Abstract of WO-2011 116981.

Hausen/Linde, Tieftemperaturtechnik [Low-Temperature Technology], 2nd Edition 1985, Chapter 4 pp. 281-337.

* cited by examiner

DEVICE FOR THE LOW-TEMPERATURE SEPARATION OF AIR

SUMMARY OF THE INVENTION

The invention relates to a device for low-temperature separation of air comprising a main heat exchanger having at least two heat-exchanger blocks, a distillation column system for nitrogen-oxygen separation having at least one high-pressure column, and a subcooling-counterflow heat exchanger which is separate from the main heat exchanger and is formed by a heat-exchanger block. The device includes means for introducing feed air, via the main heat exchanger, into the high-pressure column, and means for introducing a liquid stream from the distillation column system for nitrogen-oxygen separation into the subcooling-counterflow heat exchanger. The device also has means for introducing a gas stream from the distillation column system for nitrogen-oxygen separation into the subcooling-counterflow heat exchanger. The main heat exchanger and the subcooling-counterflow heat exchanger are arranged in a cold box.

Methods and devices for low-temperature separation of air are known, for example, from Hausen/Linde, Tieftemperaturtechnik [Low-temperature technology], 2nd edition 1985, chapter 4 (pages 281 to 337). See, for example, FIG. 4.20 which shows a the distillation column system for nitrogen-oxygen separation with pipelines for introducing feed air, via a main heat exchanger, into a high-pressure column as well as pipelines for transporting liquid and gas streams from the distillation column to the main heat exchanger and further heat exchangers.

The "distillation column system for nitrogen-oxygen separation" of the invention can be constructed as an individual column, as a two-column system (for example as a classical Linde double-column arrangement), or else as a three- or multi-column system. In addition to the columns in the distillation column system for nitrogen-oxygen separation, further devices for production of high-purity products and/or other air components, in particular noble gases, can be provided, for example argon production and/or krypton-xenon production.

A "main heat exchanger" serves for cooling feed air by indirect heat exchange with backflows from the distillation column system for nitrogen-oxygen separation (or from further columns) and can in principle be formed by a single heat-exchanger block. The main heat exchanger can be formed from one or more heat exchanger blocks connected in parallel and/or series, for example from one or more plate heat exchanger blocks. In the invention, the main heat exchanger has at least two heat-exchanger blocks.

A "subcooling counterflow heat exchanger" is a unit separate from the main heat exchanger and serves for subcooling or warming one or more liquids from one of the columns of the distillation column system for nitrogen-oxygen separation, or else from a mixed column in counterflow to one or more cold gaseous backflows. These backflows come from a column of the distillation column system (in the case of two- or multi-column systems generally from the low-pressure column) and are generally introduced into another column or a condenser-evaporator downstream of the subcooling-counterflow heat exchanger. For example, in a subcooling counterflow heat exchanger liquid streams which are expanded at boiling temperature from a column at a relatively high pressure (for example the high-pressure column of a two-column system) into a column having a lower pressure (for example the low-pressure column) are cooled as close as possible to the boiling temperature which corresponds to the lower pressure level. In this case the amount of vapor (flash) produced in the expansion from the higher pressure to the lower pressure is minimized. When liquid oxygen from a low-pressure column, before it is fed into a mixed column, is conducted through the subcooling counterflow heat exchanger, this is reciprocally warmed, in order to come as close as possible to the boiling point at the—generally higher—pressure of the mixed column. In contrast thereto, the cold backflows, which are discharged from the columns at the dew temperature, are warmed at the lower pressure. Since these streams pass into the main heat exchanger, the process air into the high-pressure column likewise becomes warmer, that is to say it is closer to the dew temperature. The fraction of preliquified air is minimized.

A special class of air separation plants has one mixed column in which liquid oxygen from the distillation column system for nitrogen-oxygen separation is brought into counterflow mass transfer with some of the feed air. Such systems have been known since the 1970s (DE 2 204 376=U.S. Pat. No. 4,022,030). Furthermore, such methods are disclosed in U.S. Pat. No. 5,454,227, U.S. Pat. No. 5,490,391, DE 19803437 A1, DE 19951521 A1, EP 1139046 B1 (=US 2001/052244 A1), EP 1284404 A1 (=U.S. Pat. No. 6,662,595 B2) (=3 U.S. Pat. No. 6,662,595 B2), DE 10209421 A1, DE 10217093 A1, EP 1376037 B1 (=U.S. Pat. No. 6,776,004 B2), EP 1387136 A1 and EP 1666824 A1.

A cold box serves for thermal insulation of plant components (see, for example, Hausen/Linde, Tieftemperaturtechnik, 1985, in particular pages 490 and 491). A "cold box" here is taken to mean an insulating casing which completely encloses by means of outer walls a heat-insulated inner chamber; in the inner chamber are arranged plant components that are to be insulated, for example one or more separation columns and/or heat exchangers. The insulating action can be effected by corresponding configuration of the outer walls and/or by filling the intermediate space between plant components and outer walls with an insulating material. In the case of the latter variant, preferably a pulverulent material is used, such as perlite, for example. Both the distillation column system for nitrogen-oxygen separation and the main heat exchanger and the subcooling-counterflow heat exchanger must be enclosed by one or more cold boxes.

In the case of relatively small plants, the subcooling counterflow heat exchanger is located next to the distillation columns. If the additional space requirements of the subcooling counterflow heat exchanger exceed the transport dimension of the column cold box, the subcooling counterflow heat exchanger is accommodated in the main heat exchanger box (the "first cold box") next to the main heat exchanger.

An object of the invention is to provide a particularly expedient arrangement of the plant components.

Upon further study of the specification and appended claims, other objects and advantages of the invention will become apparent.

These objects are achieved by arranging the top end of the subcooling-counterflow heat exchanger to be below the bottom end of the main heat exchanger wherein and the subcooling-counterflow heat exchanger, via at least one pipeline is flow-connected (i.e., provides fluid communication) to main heat exchanger, and the subcooling-counterflow heat exchanger is suspended on the main heat exchanger.

All of the details on the spatial orientation relate here to alignment of the device during operation of the columns.

A vessel (for example a column or a heat exchanger) is situated "above" (or "below") another vessel when the bottom edge (top edge) thereof is situated at a higher (lower) geodetic level than the top edge (bottom edge) of the other vessel. In this case there can, but need not be, a vertical line which passes through both vessels. In the projection on to a horizontal plane, the cross sections of the two vessels can intersect, but can also be arranged completely offset from one another. The expression "one above the other" is to be understood similarly.

The arrangement according to the invention of the subcooling-counterflow heat exchanger below the main heat exchanger at first appears to be nonsensical, because the subcooling-counterflow heat exchanger has a substantially lower volume and therefore the combination of main heat exchanger and subcooling-counterflow heat exchanger stands on its head so to speak. However, in the context of the invention, it is proved that the arrangement according to the invention is accompanied by surprisingly great advantages. In particular, the gas stream or gas streams which come from the distillation column system or a mixed column and are first warmed in the subcooling-counterflow heat exchanger are introduced with very low expenditure on piping from the top end of the subcooling-counterflow heat exchanger into the bottom end of the main heat exchanger. Furthermore, compared with an arrangement of main heat exchanger and subcooling counterflow heat exchanger next to one another, there is a lower width of the first cold box, such that this can be transported more easily, or more heat exchanger volume can be achieved within the maximum permissible transport width.

In the context of the invention, the subcooling-counterflow heat exchanger is suspended directly from the main heat exchanger, more precisely via at least one pipeline which flow-connects the main heat exchanger and subcooling-counterflow heat exchanger. The subcooling-counterflow heat exchanger can be connected to one, a plurality, or all heat exchanger blocks of the main heat exchanger. Compared with a support on the bottom, suspension of the subcooling-counterflow heat exchanger avoids the subcooling-counterflow heat exchanger having a fixed point. Also, complex expansion loops in the connections between main heat exchanger and subcooling-counterflow heat exchanger can be dispensed with. The suspension of the subcooling-counterflow heat exchanger can be provided by one or all pipelines which flow-connect main heat exchanger and subcooling-counterflow heat exchanger, or via a selection of the pipelines necessary in terms of the process. Preferably, any other support is to be dispensed with.

The vertical separation between bottom end of the main heat exchanger and top end of the subcooling counterflow heat exchanger in the device according to the invention is, for example, 1 to 7 m, preferably 2 to 5 m.

The expression "cross section of the main heat exchanger" used hereinafter is taken to mean the smallest horizontal rectangle which covers the cross sections of all heat exchanger blocks that form the main heat exchanger (see FIG. 1).

Preferably, in the invention, the subcooling-counterflow heat exchanger and main heat exchanger are arranged in such a manner that the vertical projections of the cross sections of subcooling-counterflow heat exchanger and main heat exchanger intersect on a horizontal plane, and, in particular, the vertical projection of the cross section of the main heat exchanger on to a horizontal plane completely encompasses the corresponding projection of the cross section of the subcooling-counterflow heat exchanger. In the latter case, the subcooling-counterflow heat exchanger is also arranged in the meaning of everyday speech completely below the main heat exchanger. In the most preferred arrangement, the subcooling-counterflow heat exchanger is located centrally below the main heat exchanger blocks.

It is expedient if the device comprises a second cold box that is separate from the first cold box, within which at least one column of the distillation column system for nitrogen-oxygen separation is arranged. Via the division into two or more cold boxes, medium-size plants can also be substantially prefabricated, without the permissible transport dimensions being exceeded. Each cold box, together with its internals, is completely prefabricated in the factory. The cold boxes are brought separately to the construction site, erected there and connected to one another.

In this case, all columns of the distillation column system for nitrogen-oxygen separation may be arranged outside the first cold box, in particular in the second cold box. In the latter case, therefore, all cold parts of the device are accommodated into exactly two individually transportable cold boxes.

As mentioned above, the arrangement according to the invention of the subcooling-counterflow heat exchanger can be used in all types of low-temperature air separation plants, that is to say in particular in single- or double-column systems without a mixed column. The invention can also be applied to mixed-column plants, wherein the mixed column is preferably arranged in the second cold box. Working examples of corresponding arrangements are described in WO 2011116981 A2.

The device in this case in addition comprises means for introducing feed air via the main heat exchanger into the mixed column, and also a liquid oxygen line for introducing liquid oxygen from the distillation column system for nitrogen-oxygen separation (in particular from a low-pressure column) into the upper region of the mixed column, and an oxygen product line for taking off oxygen gas from the upper region of the mixed column via the main heat exchanger.

In principle, the main heat exchanger can be supported at any desired position. However, it is particularly expedient when the top of the main heat exchanger is attached to a support within the cold box and is suspended therefrom. In particular, the main heat exchanger is suspended from carriers located at the top end of the heat exchange blocks. Such a construction is shown in detail, for example, in EP 1239254 B1 (=U.S. Pat. No. 7,325,594 B2).

BRIEF DESCRIPTION OF THE DRAWINGS

The invention and further details of the invention will be described hereinafter in more detail with reference to a working example shown schematically in the drawings. Various other features and attendant advantages of the present invention will also be more fully appreciated as the same becomes better understood when considered in conjunction with the accompanying drawings wherein.

Figure 1:
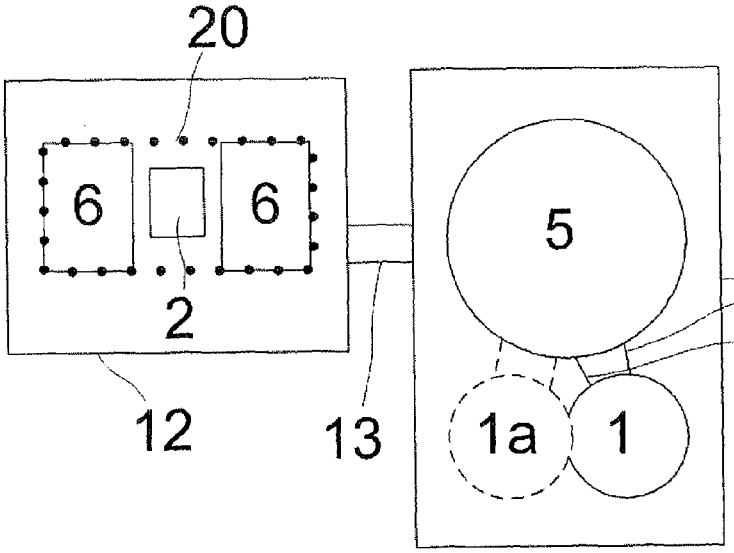
FIG. 1 shows a device according to the invention in a horizontal cross sectional view.

The working example comprises a first cold box 12 and a second cold box 3. For the two cold boxes 3, 12, only the side outer walls are shown in FIG. 1. Details such as pipelines, valves and the interior of the apparatuses 1, 2, 5, 6 are not shown. The intermediate space between the apparatuses 1, 2, 5, 6 and the outer wall of the shared cold box 3 is filled with perlite. The top sides and bottom sides of each cold box are each formed by a separate outer wall.

In the first cold box 12, a main heat exchanger 6 and a subcooling-counterflow heat exchanger 2 are arranged. The main heat exchanger 6 is formed from more than one heat-exchanger block, namely, in the example, from two plate heat-exchanger blocks connected in parallel and arranged next to one another. The "cross section" 20 of the main heat exchanger is formed here by the smallest horizontal rectangle which covers the cross sections of all blocks that form the main heat exchanger and is represented in FIG. 1 by a dotted line. The subcooling-counterflow heat exchanger 2 is formed by a single plate heat-exchanger block and is arranged centrally below the main heat exchanger. It is expedient when the subcooling-counterflow heat exchanger is arranged as far underneath as possible and thereby the height difference between the bottom of the high-pressure column and the feedpoints of the liquid streams that are to be subcooled in the subcooling-counterflow heat exchanger is as small as possible.

The distillation column system for nitrogen-oxygen separation of the working example has a high-pressure column and a low-pressure column which are implemented as a classical double-column arrangement 5 and are accommodated in the second cold box 3. The double-column 5 is supported via a frame, which is not shown, on the bottom 4 of the shared cold box 3. In the second cold box, in addition, a mixed column 1 is arranged which is supported by connection elements 10, 11 on the double column 5.

The mixed column 1 is supported exclusively on the double column, more precisely via at least two connection elements which are arranged respectively in the top and bottom region of the mixed column 1. The type of connection is described in more detail in WO 2011116981 A2. The top connection element consists of a pair of elements 10, 11 and is shown in FIG. 1.

The dashed circle 1*a* is a modification of the working example in which the mixed column is arranged differently.

Figure 2:
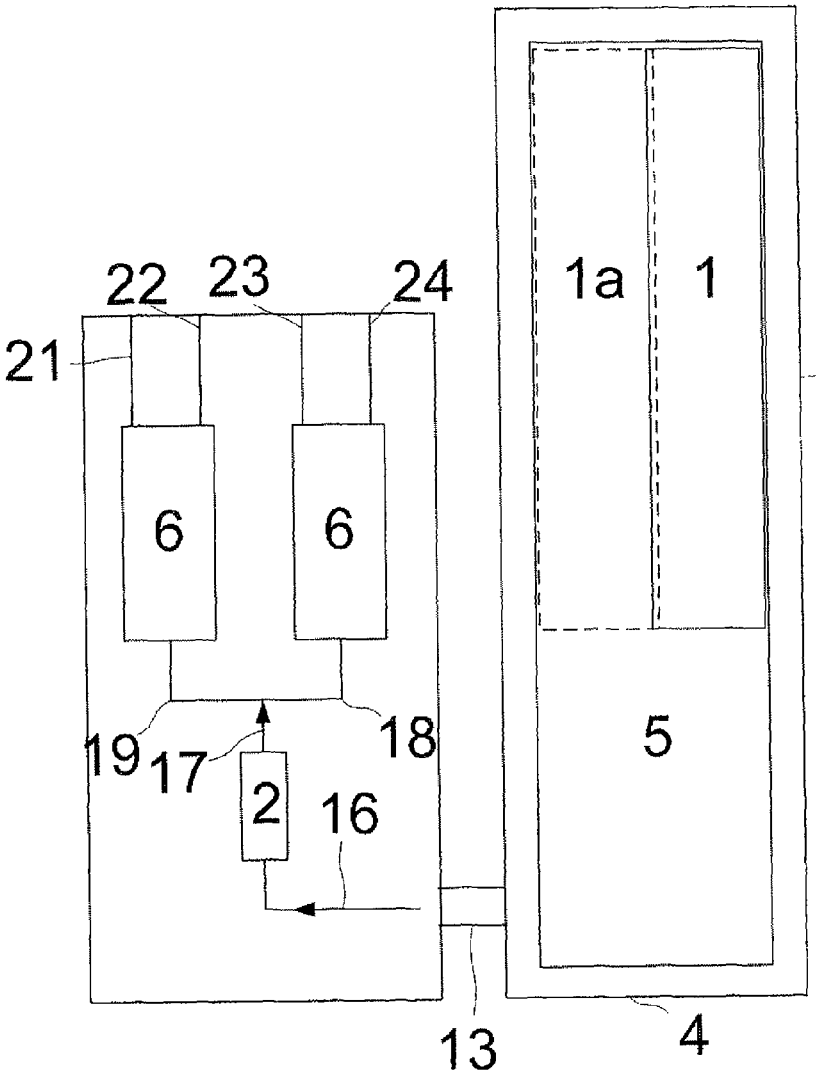
FIG. 2 shows the same device, the first cold box as first working example in vertical cross sectional view.

In FIG. 2, furthermore, one of the pipeline connections between main heat exchanger 6, subcooling-counterflow heat exchanger 2 and second cold box 3 is indicated as a drawing (the usual further connections between distillation column system and main heat exchanger are not shown here). Via line 16, pure or impure nitrogen from the low-pressure column (top part of the double column 5) is introduced and fed into the bottom end of the subcooling-counterflow heat exchanger 2. The nitrogen warmed in the subcooling-counterflow heat exchanger is taken off via line 17 from the top end of the subcooling-counterflow heat exchanger 2, divided via a pair of lines 18, 19 among the two blocks of the main heat exchanger 6 and flows into the bottom end thereof. At the top, warm end of the main heat exchanger, the nitrogen is then taken off at about ambient temperature (which is not shown). In the working example, the subcooling-counterflow heat exchanger is suspended exclusively via the lines 17, 18 and 19 on the main heat exchanger 6; further support or suspension facilities are not provided. Alternatively, one or more further pipelines which flow-connect the main heat exchanger and subcooling-counterflow heat exchanger can be used for suspending the subcooling-counterflow heat exchanger on the main heat exchanger. As shown in FIG. 2, the main heat exchanger 6 can be suspended 21, 22, 23, 24 from the top of the heat exchange blocks.

The entire disclosure[s] of all applications, patents and publications, cited herein and of corresponding German Application No. 10 2011 015 233.4, filed Mar. 25, 2011, are incorporated by reference herein.

The preceding examples can be repeated with similar success by substituting the generically or specifically described reactants and/or operating conditions of this invention for those used in the preceding examples.

The invention claimed is:

1. An apparatus for the low-temperature separation of air comprising:

a main heat exchanger (6) which comprises at least two heat-exchanger blocks, a distillation column system for nitrogen-oxygen separation (5) that has at least one high-pressure column, a subcooling-counterflow heat exchanger (2) which is separate from the main heat exchanger and is formed by a heat-exchanger block, a pipeline for introducing feed air via the main heat exchanger (6) into the high-pressure column, a pipeline for introducing a liquid stream from the distillation column system for nitrogen-oxygen separation (5) into the subcooling-counterflow heat exchanger (2), a pipeline for introducing a gas stream (16) from the distillation column system for nitrogen-oxygen separation (5) into the subcooling-counterflow heat exchanger (2), wherein the main heat exchanger (6) and the subcooling-counterflow heat exchanger (2) are arranged in a first cold box (12), the top end of the subcooling-counterflow heat exchanger (2) is arranged below the bottom end of the main heat exchanger (6), and the subcooling-counterflow heat exchanger (2), via at least one pipeline (17, 18, 19) which provides fluid communication between the main heat exchanger (6) and subcooling-counterflow heat exchanger (2), is suspended from the main heat exchanger (6), and said at least one pipeline (17, 18, 19) is the sole means for suspending the subcooling-counterflow heat exchanger (2) from the main heat exchanger (6).

2. The apparatus according to claim 1, wherein vertical projections of horizontal cross sections of subcooling-counterflow heat exchanger (2) and main heat exchanger (6) intersect on a horizontal plane.

3. The apparatus according to claim 1, wherein the vertical projection of a horizontal cross section (20) of the main heat exchanger (6) on to a horizontal plane completely encompasses the corresponding vertical projection of a horizontal cross section of the subcooling-counterflow heat exchanger (2).

4. The apparatus according to claim 1, wherein at least one column of the distillation column system for nitrogen-oxygen separation (5) is arranged in a second cold box (3) that is separate from the first cold box (12).

5. The apparatus according to claim 2, wherein at least one column of the distillation column system for nitrogen-oxygen separation (5) is arranged in a second cold box (3) that is separate from the first cold box (12).

6. The apparatus according to claim 3, wherein at least one column of the distillation column system for nitrogen-oxygen separation (5) is arranged in a second cold box (3) that is separate from the first cold box (12).

7. The apparatus according to claim 1, wherein all columns of the distillation column system for nitrogen-oxygen separation (5) are arranged outside the first cold box (12).

8. The apparatus according to claim 7, wherein all columns of the distillation column system for nitrogen-oxygen separation (5) are arranged in a second cold box (3) that is separate from the first cold box (12).

9. The apparatus according to claim 1, wherein a mixed column (1, 1*a*) is arranged in a second cold box (3) that is separate from the first cold box (12).

10. The apparatus according to claim 1, wherein the main heat exchanger (6) is suspended from the top thereof.

11. The apparatus according to claim 4, wherein the intermediate space of the outer wall of the second cold box (3) and structures contained therein is filled with perlite.

12. The apparatus according to claim 1, wherein the vertical separation between the bottom end of the main heat exchanger and the top end of the subcooling counterflow heat exchanger is 1 to 7 m.

13. The apparatus according to claim 1, wherein the vertical separation between the bottom end of the main heat exchanger and the top end of the subcooling counterflow heat exchanger is 2 to 5 m.

14. The apparatus according to claim 1, wherein the subcooling-counterflow heat exchanger is located centrally below said at least two heat-exchanger blocks of the main heat exchanger.

15. The apparatus according to claim 1, wherein the distillation column system for nitrogen-oxygen separation comprises said high-pressure column and a low-pressure column in a double-column arrangement.

* * * * *